US005597528A

United States Patent [19]

Whaley

[11] Patent Number: 5,597,528

[45] Date of Patent: Jan. 28, 1997

[54] IMPACT PAD

[75] Inventor: Lee R. Whaley, St. Clair, Pa.

[73] Assignee: A.P. Green Industries, Inc., Mexico, Mo.

[21] Appl. No.: 522,198

[22] Filed: Aug. 31, 1995

[51] Int. Cl.[6] ..... C21B 7/24

[52] U.S. Cl. ..... 266/100; 266/236; 266/275

[58] Field of Search ..... 266/99, 100, 275, 266/287, 236; 222/594

[56] References Cited

U.S. PATENT DOCUMENTS

| | | | |
|---|---|---|---|
| 2,874,427 | 2/1959 | Sterick | 22/139 |
| 3,195,853 | 7/1965 | Ferree | 249/206 |
| 4,209,162 | 6/1980 | Petiau | 249/206 |
| 4,744,544 | 5/1988 | LaBate et al. | 266/100 |
| 5,072,916 | 12/1991 | Soofi | 266/275 |
| 5,110,096 | 5/1992 | Zacharias | 266/227 |
| 5,131,635 | 7/1992 | Soofi | 266/275 |
| 5,133,535 | 7/1992 | Soofi | 266/275 |
| 5,169,591 | 12/1992 | Schmidt et al. | 266/275 |
| 5,188,796 | 2/1993 | Soofi | 266/275 |
| 5,196,051 | 3/1993 | Heaslip et al. | 75/582 |

*Primary Examiner*—Scott Kastler

*Attorney, Agent, or Firm*—Senniger, Powers, Leavitt & Roedel

[57] ABSTRACT

An impact pad for use in a ladle for molten metal comprising a body of refractory material having a lower portion shaped to fit in a ladle and a tapered upper portion having corrugations at the top, the lower portion being grooved around its periphery and having refractory bricks of contrasting color with respect to the refractory material of the body embedded in the body, adapted to be exposed on wearing away of the body.

11 Claims, 2 Drawing Sheets

IMPACT PAD

BRIEF SUMMARY OF THE INVENTION

This invention relates to an impact pad such as used on the bottom of a ladle for molten metal, e.g. molten steel.

While the invention is especially directed to an impact pad for a ladle for molten metal, it will be understood that the principles of the invention are applicable to an impact pad for use in various vessels into which molten metal is poured, e.g., an impact pad for use in a tundish.

Among the several objects of the invention may be noted the provision of an impact pad of the class above described having a relatively long life for the environment in which it is used, without unduly increasing the size or cost of the pad; the provision of such a pad for use on the bottom of a ladle or other vessel having refractory material poured in place on the bottom of the vessel around the pad with the pad so formed as to provide a more leak-proof joint between the pad and the poured-in-place surrounding material better to avoid penetration of molten metal between the perimeter of the pad and the cast-in-place surrounding material; and the provision of such a pad having means incorporated therein for indicating wearing away of the pad to the point where it should be replaced.

In general, an impact pad of this invention for use on the bottom of a vessel into which molten metal is poured comprises a body of refractory material having a lower portion of such shape in plan as to fit in the vessel on the bottom of the vessel with space around said lower portion for pouring of refractory material around said lower portion and an upper portion integral with the lower portion tapering upwardly from the lower portion having a generally horizontal upper area of smaller shape in plan than the shape in plan of the lower portion. The horizontal upper area has opposite sides and corrugations extending from one of said sides to the other. The lower portion of the body is grooved around its periphery for interlocking with the poured refractory material, and has means therein which is exposed on wearing away of the body visually to indicate a need for replacement of the pad.

Other objects and features will be in part apparent and in part pointed out hereinafter.

BRIEF DESCRIPTION OF THE DRAWINGS

Corresponding reference characters indicate corresponding parts throughout several view of the drawings.

DETAILED DESCRIPTION

Figure 1:
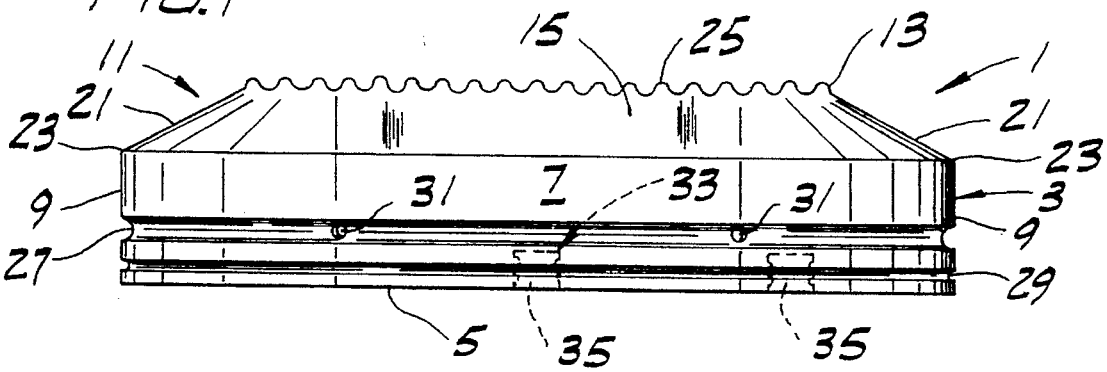
FIG. 1 is a view in side elevation of an impact pad of the invention.
Figure 2:
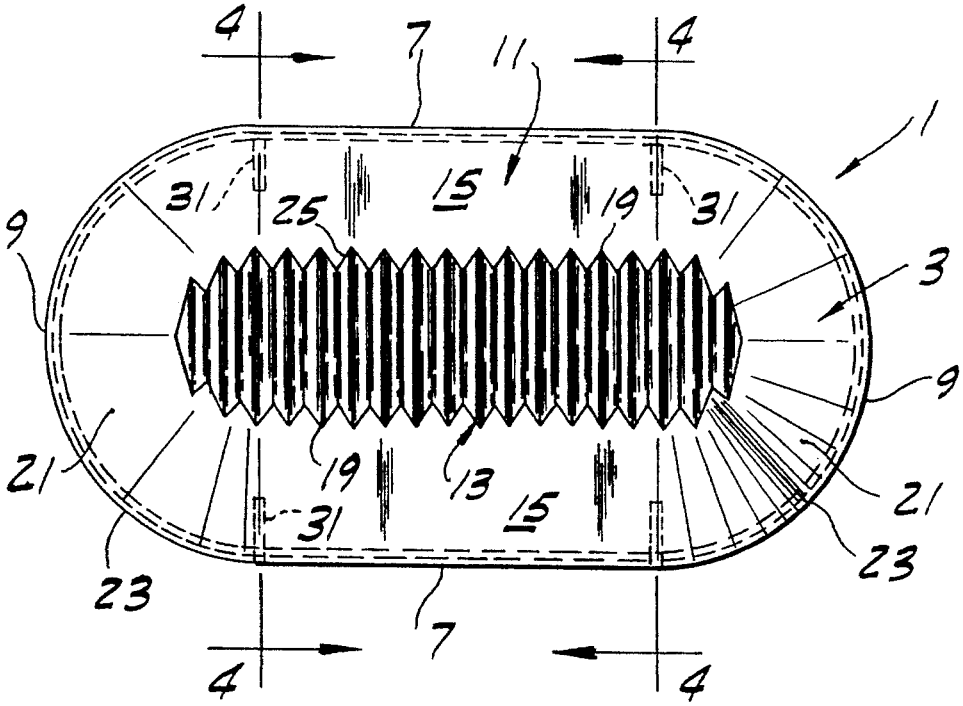
FIG. 2 is a view in plan of the pad.
Figure 3:
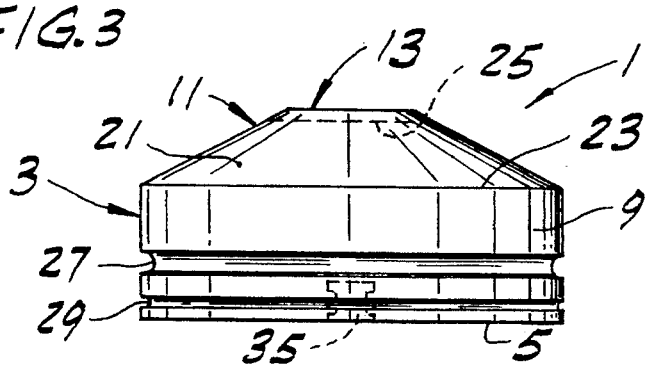
FIG. 3 is a view in end elevation (either end) of the pad.
Figure 4:
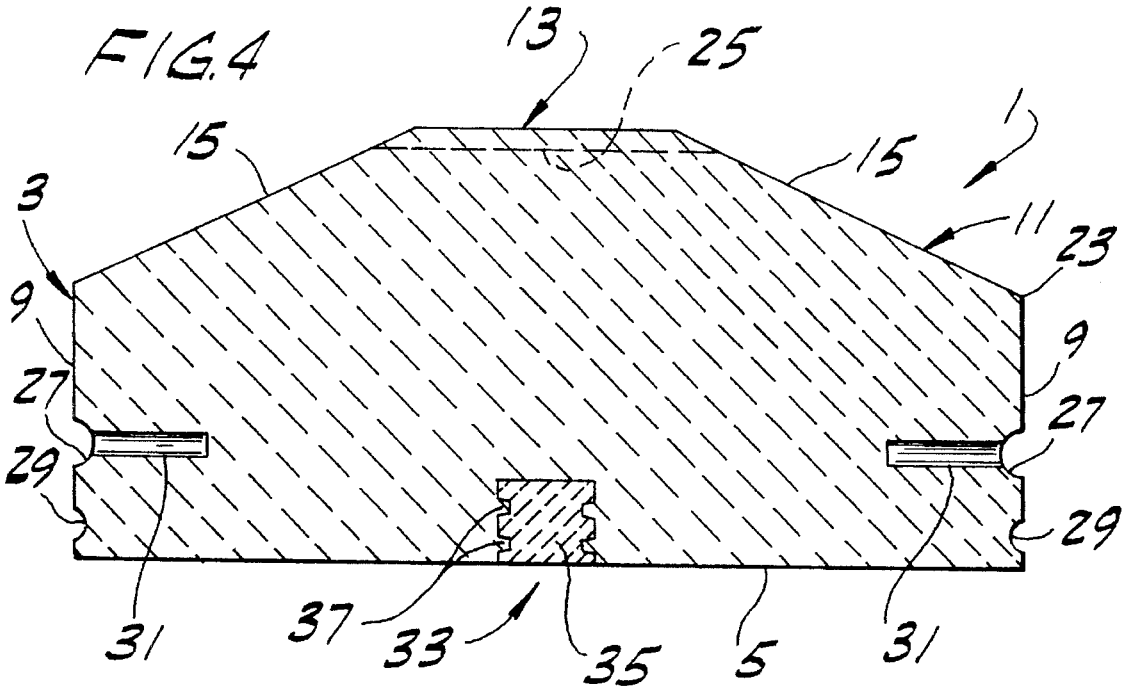
FIG. 4 is view in section on either of lines 4—4 of FIG. 2 on a larger scale than FIG. 2.

Referring to the drawings, an impact pad of this invention, shown per se in FIGS. 1–4, is designated in its entirety by the reference numeral 1. The pad of the shape shown is for use on the bottom of a vessel, more particularly a ladle, into which molten metal, e.g. molten steel, is poured. The pad comprises a body of refractory material, more particularly a heat-resistant castable refractory material, having a lower portion generally designated 3 of such shape in plan as to fit in the ladle on the bottom of the ladle with space around said lower portion for pouring of refractory material in the ladle around said lower portion, the latter thereby being embedded in the poured-in-place refractory material. The lower portion 3 is generally of what may be termed elongate oval shape (see FIG. 2) in plan having a generally flat bottom 5, generally flat, vertical opposite side surfaces each designated 7 extending parallel to one another, and semicircular vertical end surfaces each designated 9, being relatively long in relation to its width. In a typical embodiment, the lower portion 3 of the pad is seventy-nine inches long from end to end, forty inches wide and twelve inches high.

Surmounting the lower portion 3 of the pad is an upper portion generally designated 11 which is integral with the lower portion 3 and which tapers upwardly from the lower portion, having a generally horizontal upper area 13 of smaller shape in plan than the shape in place of the lower portion, but of shape (elongate oval shape) corresponding to that of the lower portion. The upper portion 11 has inclined side surface indicated at 15 sloping up from the upper edges 17 of the sides 7 of the lower portion to the upper area 13, which may be referred to as the plateau of the pad, to the opposite sides such as indicated at 19 of the upper area. In further detail, the upper portion 11 has part-conical end surfaces each designated 21 extending up from the upper edges 23 of the semicircular ends 9 of the lower portion 3 to blend with the sloping side surfaces 15 of the upper portion.

The horizontal upper area (plateau) 13 has corrugations such as indicated at 25 extending from one of its sides 19 to the other. In the above-noted embodiment, the height of the pad from the bottom 5 to the plane of the top of the corrugations is nineteen inches. The corrugations are forward with a three-inch pitch an a one-inch depth. The side surfaces 15 and the end surfaces 21 of the upper portion 11 are inclined at an angle of about 26° to horizontal.

The lower portion of the pad or body 1 is grooved around its periphery for interlocking with the refractory material which, as above described, is poured into the ladle around the lower part 3 of the pad. As shown, two such grooves are provided, an upper groove 27 and a lower groove 29. In the aforesaid embodiment of the pad of this invention, the upper groove 27 is located with its center line five inches above the bottom 5 of the pad and the lower groove is located with its center line one and one-half inches above the bottom of the pad. Each groove is semicircular, the upper groove having for example a two-inch radius, the lower groove being narrower, having for example a half-inch radius. The grooves extend entirely around the lower portion 3 of the pad in the sides 7 and ends 9 thereof. Holes such as indicated at 31 are provided in the lower portion 3 of the pad extending inwardly from the bottom of the side portions of the upper groove 27 for the reception of means for lifting the pad and lowering it into position on the bottom of a ladle.

Further, the pad or body 1 has means indicated generally at 33 in the lower portion thereof which is exposed on wearing away of the upper part of the pad generally down to a level somewhat below the level of the upper groove 27 visually to indicate a need for replacement of the pad in the ladle. More particularly, this means comprises a plurality of bricks each designated 35, each being a pressed brick of high-fired heat resistant material of a different color than that of the body 1 embedded in the lower part 3 of the body, with the top of each of the bricks within said lower part 3 of the body at a level between the levels of the grooves 27 and 29 the bricks having their bottoms flush with the bottom 5 of the pad or body. Here it may be pointed out that the pad or body 1 is made by providing a mold with parts formed to provide a cavity corresponding in shape to that of the pad or body, and with formations for forming the corrugations 25, the grooves 27 and 29 and the holes 31, positioning the mold with the mold cavity opening upward and with the corrugation—forming formation at the bottom, pouring castable refractory material into the mold to fill it up to the level corresponding to the level of the top of the bricks, then setting the bricks in place and completing the filling of the mold with the refractory material up to the level of what becomes the bottom 5 of the body or pad and where the refractory material is flush with the then uppermost faces the bricks. As illustrated, two such bricks are provided, one at the center and one toward one end of the pad or body, located on the longitudinal center line of the pad or body. The bricks are grooved as indicated at 37 in FIG. 4 for being interlocked in the lower portion 3 of the pad.

Figure 5:
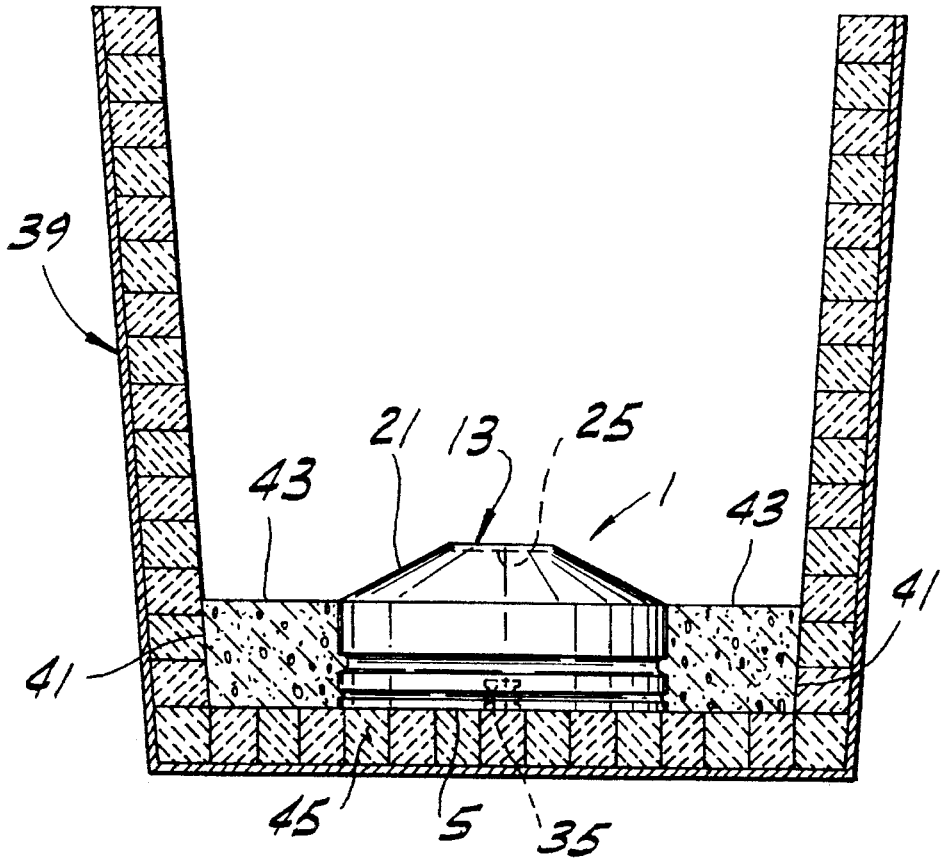
FIG. 5 is a view in section showing the pad as used in a ladle.

FIG. 5 shows how the pad or body 1 is placed in a ladle such as indicated at 39 on the bottom of the ladle. The pad, in plan, is smaller than the bottom of the ladle so as to fit in the ladle initially with a space such as indicated at 41 all around the pad. The bottom of the pad bears on the bottom 45 of the ladle. With the pad so applied, castable refractory material indicated at 43 is poured into said space 41 to fill it generally up to the level of the top of the lower part 3 of the pad. The poured-in-place refractory material infills the grooves 27 and 29, thus providing for interlocking of the pad with the poured-in-place material when it hardens. With the two grooves 27 and 29, there is double protection against molten metal in the ladle leaking down around the pad to the bottom of the ladle.

It will be understood that the elongate oval shape shown for the pad and the dimensions stated above are only by way of example, and that the pad may be made of other shapes in plan and with other dimensions.

In view of the above, it will be seen that the several objects of the invention are achieved and other advantageous results attained.

As various changes could be made in the above constructions without departing from the scope of the invention, it is intended that all matter contained in the above description shall be interpreted as illustrative and not in a limiting sense.

What is claimed is:

1. An impact pad for use on the bottom of a vessel into which molten metal is poured comprising a body of refractory material having:

a lower portion of such shape in plan as to fit in the vessel on the bottom of the vessel with space around said lower portion for pouring of refractory material around said lower portion, said lower portion having opposite sides and ends each having an upper edge;

an upper portion integral with the lower portion tapering upwardly from the upper edges of the sides and ends of the lower portion having a generally horizontal upper area of smaller shape in plan than the shape in plan of the lower portion;

said horizontal upper area having opposite sides and corrugations extending from one of said sides to the other;

said lower portion of the body being grooved around its periphery for interlocking with the poured refractory material; and means in said lower portion of the body which is exposed on wearing away of the body visually to indicate a need for replacement of the pad said means having an upper end surface below said upper portion of the body.

2. An impact pad as set forth in claim 1 wherein said lower portion of the body is grooved to have an upper groove and a lower groove each extending completely around its periphery.

3. An impact pad for use on the bottom of a vessel into which molten metal is poured comprising a body of refractory material having:

a lower portion of such shape in plan as to fit in the vessel on the bottom of the vessel with space around said lower portion for pouring of refractory material around said lower portion;

an upper portion integral with the lower portion tapering upwardly from the lower portion having a generally horizontal upper area of smaller shape in plan than the shape in plan of the lower portion;

said horizontal upper area having opposite sides and corrugations extending from one of said sides to the other;

said lower portion of the body being grooved around its periphery for interlocking with the poured refractory material; and means in said lower portion of the body which is exposed on wearing away of the body visually to indicate a need for replacement of the pad;

wherein said wear-indicating means comprises at least one refractory member embedded in the body of a different color than the refractory material of said body.

4. An impact pad as set forth in claim 3 wherein said wear-indicating means comprises a plurality of bricks of refractory material having a different color than the refractory material of the body, the bricks being spaced from each other, each brick having a bottom generally flush with the bottom of the body and a top below the level of said horizontal upper area.

5. An impact pad as set forth in claim i wherein said lower portion of the body is grooved to have an upper groove and a lower groove each extending completely around its periphery, and wherein said wear-indicating means comprises a plurality of bricks of refractory material having a different color than the refractory material of the body, the bricks being spaced from each other, each brick having a bottom generally flush with the bottom of the body and a top below the level of said horizontal upper area, and at a level between the levels of the grooves.

6. An impact pad as set forth in claim 1 wherein said lower portion has flat vertical side surfaces parallel to one another and vertical ends, and said upper portion has flat side surfaces sloping up from the upper edges of the side surfaces to said horizontal upper area and end surfaces sloping up from the upper edges of the end surfaces.

7. An impact pad as set forth in claim 6 wherein the sloping surfaces of the upper portion of the body are inclined at an angle of about 26° to horizontal.

8. An impact pad as set forth in claim 6 wherein said lower portion of the body is grooved to have an upper groove and a lower groove each extending completely around its periphery.

9. An impact pad for use on the bottom of a vessel into which molten metal is poured comprising a body of refractory material having:

a lower portion of such shape in plan as to fit in the vessel on the bottom of the vessel with space around said lower portion for pouring of refractory material around said lower portion;

an upper portion integral with the lower portion tapering upwardly from the lower portion having a generally horizontal upper area of smaller shape in plan than the shape in plan of the lower portion;

said horizontal upper area having opposite sides and corrugations extending from one of said sides to the other;

said lower portion of the body being grooved around its periphery for interlocking with the poured refractory material; and means in said lower portion of the body which is exposed on wearing away of the body visually to indicate a need for replacement of the pad, wherein said lower portion has flat vertical side surfaces parallel to one another and vertical ends, and said upper portion has flat side surfaces sloping up from the upper edges of the side surfaces to said horizontal upper area and end surfaces sloping up from the upper edges of the end surfaces, and wherein said wear-indicating means comprises at least one refractory member embedded in the body of a different color than the refractory material of said body.

10. An impact pad as set forth in claim 9 wherein said wear-indicating means comprises a plurality of bricks of refractory material having a different color than the refractory material of the body, the bricks being spaced from each other, each brick having a bottom generally flush with the bottom of the body and a top below the level of said horizontal upper area.

11. An impact pad as set forth in claim 6 wherein said lower portion of the body is grooved to have an upper groove and a lower groove each extending completely around its periphery, and wherein said wear-indicating means comprises a plurality of bricks of refractory material having a different color than the refractory material of the body, the bricks being spaced from each other, each brick having a bottom generally flush with the bottom of the body and a top below the level of said horizontal upper area and at a level between the levels of the grooves.

* * * * *